US005586624A

United States Patent [19]

Ko et al.

[11] Patent Number: 5,586,624

[45] Date of Patent: Dec. 24, 1996

[54] FLY WHEEL BRAKE DEVICE FOR AN EXERCISE BICYCLE

[76] Inventors: Wen-Chung Ko; Kent Ko; Chin-Jen Fu, all of No. 342, Ta tung Rd., Kwei San Hsian, Tau Yuan Shien, Taiwan

[21] Appl. No.: 522,927

[22] Filed: Sep. 1, 1995

[51] Int. Cl.[6] ..... A63B 22/06; B60L 7/00

[52] U.S. Cl. ..... 188/164; 482/63; 482/903

[58] Field of Search ..... 188/161, 163, 188/164, 267; 310/93, 105; 482/5, 6, 57, 63, 903; 242/288

[56] References Cited

U.S. PATENT DOCUMENTS

| | | | |
|---|---|---|---|
| 4,452,445 | 6/1984 | Csekes | 482/903 |
| 4,826,150 | 5/1989 | Minoura | 310/105 |
| 5,054,587 | 10/1991 | Matsui et al. | 188/267 |
| 5,072,930 | 12/1991 | Sun | 482/63 |
| 5,096,024 | 3/1992 | Wu | 188/267 |
| 5,234,083 | 8/1993 | Lee | 188/267 |
| 5,236,069 | 8/1993 | Peng | 188/267 |
| 5,247,854 | 9/1993 | Wu | 482/63 |

*Primary Examiner*—Robert J. Oberleitner
*Assistant Examiner*—Chris Schwartz
*Attorney, Agent, or Firm*—Morton J. Rosenberg; David I. Klein

[57] ABSTRACT

A fly wheel brake device is provided for use in the load adjustment of a permeation fly wheel of an exercise bicycle and other exercising recovery devices. One end of a rotary handle is connected to a brake cable and the other end thereof is connected to a rotary disk so that the rotary disk is driven by the brake cable. The upper side of a plurality of sector sliding blocks each have attached thereto a convex column positioned along a cambered slot in the rotary disk, the lower side of the sector sliding blocks are each provided with an integral disk and permanent magnets. A plurality of aluminum sheets are provided on the bevelled inner circle of the permeation fly wheel and sustain a gap with the permeation magnets. The rotary handle drives the rotary disk to rotate forward or backward under the operation of the cable, thus causing the sector sliding blocks to slide forward or backward, respectively. That adjusts the gap and the magnetic contacting force between the permanent magnets and the aluminum sheets in the permeation fly wheel. Because of the change of the magnetic gap and the magnetic contacting area, the magnetic force between the permanent magnets on the sector sliding block and the permeation fly wheel are adjusted.

6 Claims, 4 Drawing Sheets

FLY WHEEL BRAKE DEVICE FOR AN EXERCISE BICYCLE

BACKGROUND OF THE INVENTION

1. Field of the Invention

The present invention relates to a fly wheel brake adjusting device for an exercise bike, especially to the device used in the load adjusting of the fly wheel of the exercise bike, with saved component cost and accurate adjusting of the loading force of the fly wheel.

2. Description of the Prior Art

Indoor exercise has become more and more popular recently for promoting health. The exercise bike is the most preferred item in indoor exercise because it is easy to operate and can achieve a preferred effect.

But in the exercise bicycles used in the prior art, the main component is the fly wheel driven by foot plates. In general, the driving of the fly wheel is adjusted according to the users physique and exercise requirement. That is to say, in order for the user to feel that he is driving along an upward incline, downward incline, or along a level plane, the load of the fly wheel must be adjusted.

In the prior art, a fly wheel brake device is provided on the bicycle for the adjustment of the fly wheel. The fly wheel brake devices used in the prior art contain a mechanical brake device and an electromechanical brake device, wherein friction force and oil pressure are used in the mechanical brake device. The defects of the friction brake device are that the components wear easily, the brake is difficult to adjust, and it is unsteady. Also, in the oil pressure brake device, the oil in the oil pressure pipe drains to the outside, the noise level produced thereby is high and the system is unsteady due to the high temperature braking. Consequently, the mechanical braking method is unsteady in operation.

In the electromechanical brake device, the flywheel drives a generator and fan. The area of the fan is too large, having an adverse effect on appearance, and further, the adjustment range of the load is limited so that neither stepless nor a wide range of adjustment are possible. Moreover, the generator is expensive to manufacture and difficult to assemble. So the large area, high cost and difficulty in assembly are the main defects of the electromechanical brake device.

SUMMARY OF THE INVENTION

Accordingly, it is the main object of the present invention to provide a fly wheel brake device for an exercise bicycle, wherein a rotary handle, a rotary disk, a sector sliding block, a fixing rail disk, a plurality of aluminum sheets and other elements are installed in the permeation fly wheel and are assembled along the driving axle for driving the permeation fly wheel. One end of the rotary handle is connected to the brake cable and the other end thereof is connected to the rotary disk so that the rotary disk is driven thereby. The upper side of the sector sliding block engages a convex column positioned along the cambered slot on the rotary disk, and the periphery of the other side thereof is provided with an integral magnet and permanent magnets. A plurality of aluminum sheets are provided on the bevel of the inner circle of the permeation fly wheel and sustain the gap with the permeation magnet so that the rotary handle can drive the rotary disk to rotate forward or backward, responsive to the operation of the cable. As a result, the sector sliding block also slides forward or backward, respectively, and therefore, the gap and the magnetic coupling force between the permanent magnet and the aluminum sheets in the permeation fly wheel are also changed. In summary, because of the changes of the magnetic gap and the magnetic contacting area, the magnetic force between the permanent magnet on the sector sliding block and the permeation fly wheel can be adjusted by the permeation fly wheel. Therefore, a convenient electromagnetic brake control is used to replace conventional mechanic brake and electromechanical brake devices, and the brake force is adjusted conveniently by the driving of the permeation fly wheel.

It is another object of the present invention to provide a brake device for an exercise bicycle wherein a rotary handle, a rotary disk, a sector sliding block, a fixing rail disk, a plurality of aluminum sheets and other elements are installed in the permeation fly wheel, so that the driving load of the bicycle can be adjusted by the electromagnetic brake device through the driving of the fly wheel, thus the cost of the bicycle is lower and the assembly thereof is more convenient.

It is the further object of the present invention to provide a brake device for the exercise bicycle, especially wherein the magnetic gap and the magnetic contacting area between the permanent magnet on the sector sliding block and aluminum sheets on the permeation fly wheel are adjusted steplessly by the operation of the brake cable comprising a rotary handle and an elastic element, so that the loading with respect to the driving rotation of the permeation fly wheel is adjusted steplessly, accurately and conveniently.

DESCRIPTION OF THE PREFERRED EMBODIMENT

Figure 1:
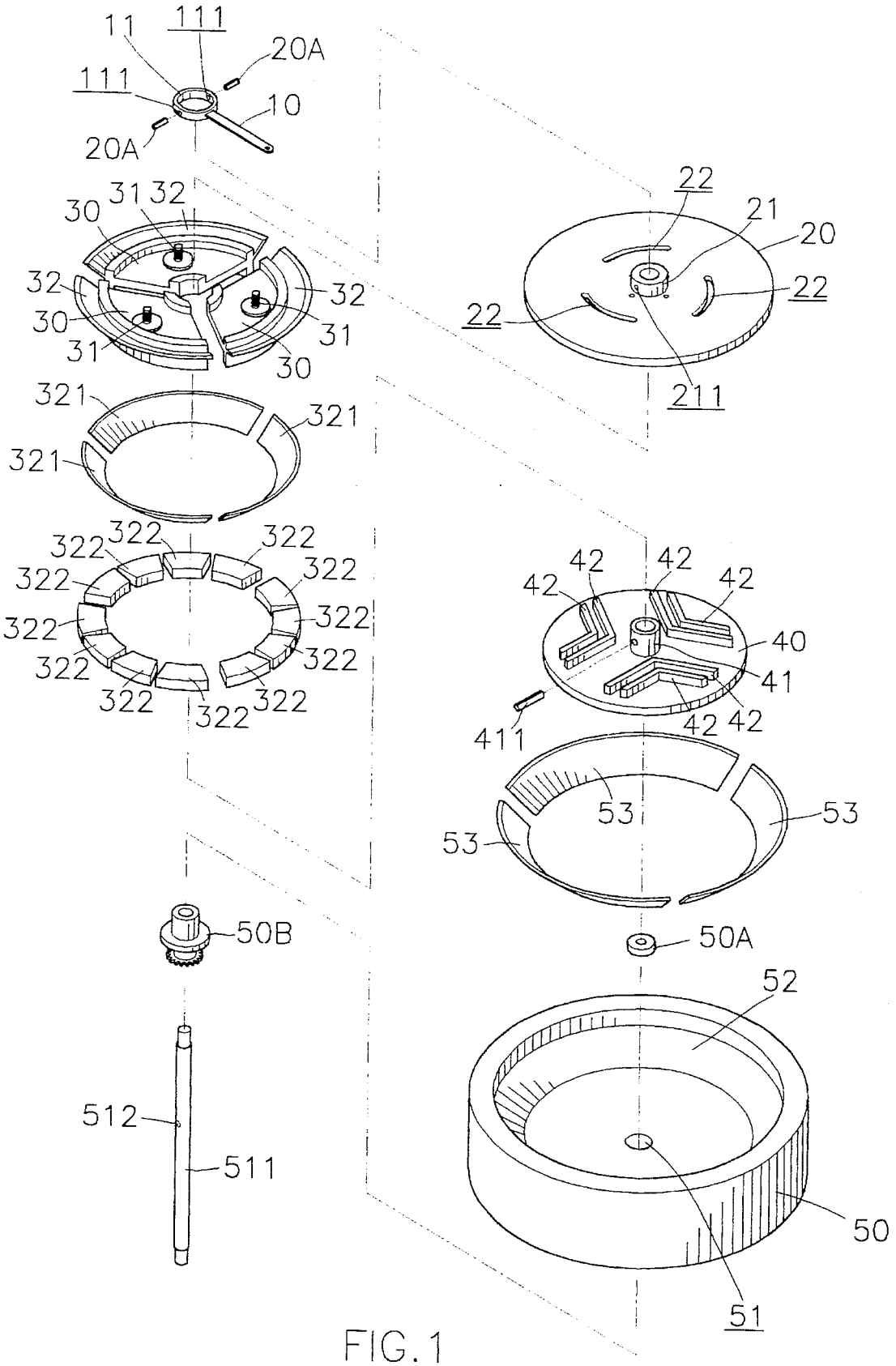
FIG. 1 is a three dimensional exploded view of the present invention.
Figure 2:
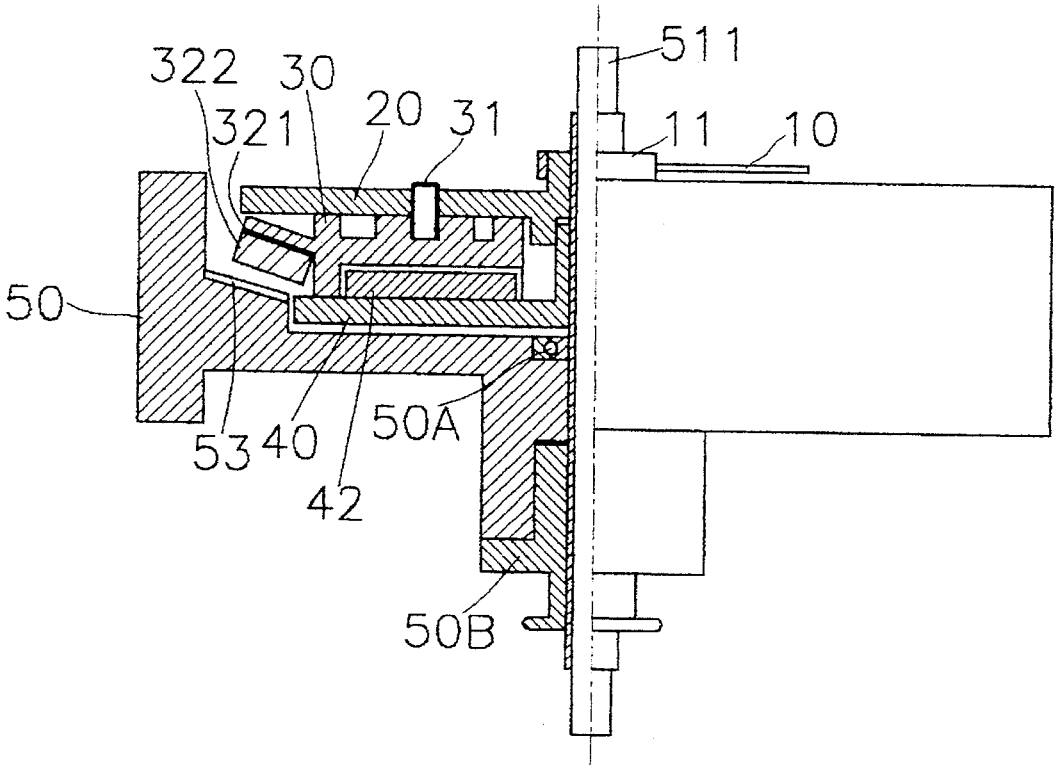
FIG. 2 is the cross sectional view of the present invention.

Referring to FIGS. 1 and 2, the fly wheel brake device of the present invention includes a rotary handle 10, wherein one end of the rotary handle 10 is provided with a retaining ring 11 on each side of which is provided a button hole. A rotary disk 20 has a hollow flange 21 at the center thereof, which flange corresponds to retaining ring 11. Each side of the hollow flange 21 is provided with a penetrating hole 211 which receives one of two elastic pins 20A for coupling the hollow flange 21 to the retaining ring 11 of the rotary handle 10, and on the periphery of the rotary disk 20 a plurality of cambered slots 22 are provided with equal angles between each other (in the present invention there are three equal parts). Each of the cambered slots 22 has one end thereof positioned further from the flange 20 than the other end of the same cambered slot.

A plurality of sector sliding blocks 30 are formed as sections with equal angles therebetween (in the present invention there are three equal angles of 120 degrees). A convex column 31 corresponding to cambered slot 22 is provided on one side of the sector sliding block 30 so as to engage the cambered slot 22. When the rotary disc 20 is rotatively displaced relative to the sector sliding blocks lying adjacent thereto, each convex column 31 is forced to travel along a cambered path defined by a respective cambered slot 22 provided in the rotary disk 20. For example, if the direction of rotary displacement is such that each of the convex columns 31 begins from that end of its respective slot 22 farthest from the central flange 21, and then travels toward that end of its respective slot 22 closest to the flange 21, then each of the sector sliding blocks 30, being attached to respective convex columns 31, will necessarily slide radially inward (their positions contract toward the centrally positioned flange 21). If the direction of rotary displacement is reversed, then the sector sliding blocks will necessarily slide radially outward (their positions expand away from the centrally positioned flange 21). Thus, the extent of the camber provided by the cambered slots 22 defines the extent of (inward) contraction or (outward) expansion experienced by the sector sliding blocks 30.

Another sloping camber 32 is provided on each side of the sector sliding block 30, the outside thereof is combined with an integral disc 321 with which a plurality of permanent magnets 322 is combined so that the permanent magnets 322 form an angle dependent on the sloping camber 32.

A fixing rail disk 40 has at the center thereof a hollow sleeve spindle 41 corresponding to the hollow flange 21 of the rotary disk, whereby the sector sliding block 30 is clamped between the rotary disk 20 and the fixing rail disk 40. A plurality of V shape rails 42 are provided on one side of the fixing rail disk 40, and the curved angles of the two sides of the V shape rail 42 correspond to the curved angle of the sector sliding block (i.e., 120 degrees). The V shape rails 42 provide even support to respective sector sliding blocks 32 as the sector sliding blocks 32 are caused to slide inward or outward in response to rotative displacement between the rotary disc 20 and the sector sliding blocks 32, as was described previously.

The permeation fly wheel 50 is constructed of magnetic or permeated materials and has at its center an engaged hole 51. The bearing 50A permits the fly wheel 50, fixedly coupled to the driving element 50B, to rotate about the fixed axle 511. Elastic pin 411 penetrates the hollow sleeve spindle 41 and engages the engaging hole 512 formed in the fixed axle 511, thus fixing the fixing rail disc 40 to the fixed axle 511. As shown by the dashed lines in FIG. 1, the rotary disk 20, sector sliding block 30 and the fixing rail disk 40 are serially aligned along the fixed axle 512 and positioned within the permeation fly wheel 50. The bevel on the inner circle of the permeation fly wheel is provided with a pair of bevelled permanent magnets 52 and a plurality of aluminum sheets are adhered thereto. The aluminum sheets can be replaced with copper sheets. A gap with varying length and magnetic contacting area is sustained between the permanent magnet 322 of the sector sliding block 30 and aluminum sheets 53.

Figure 3:
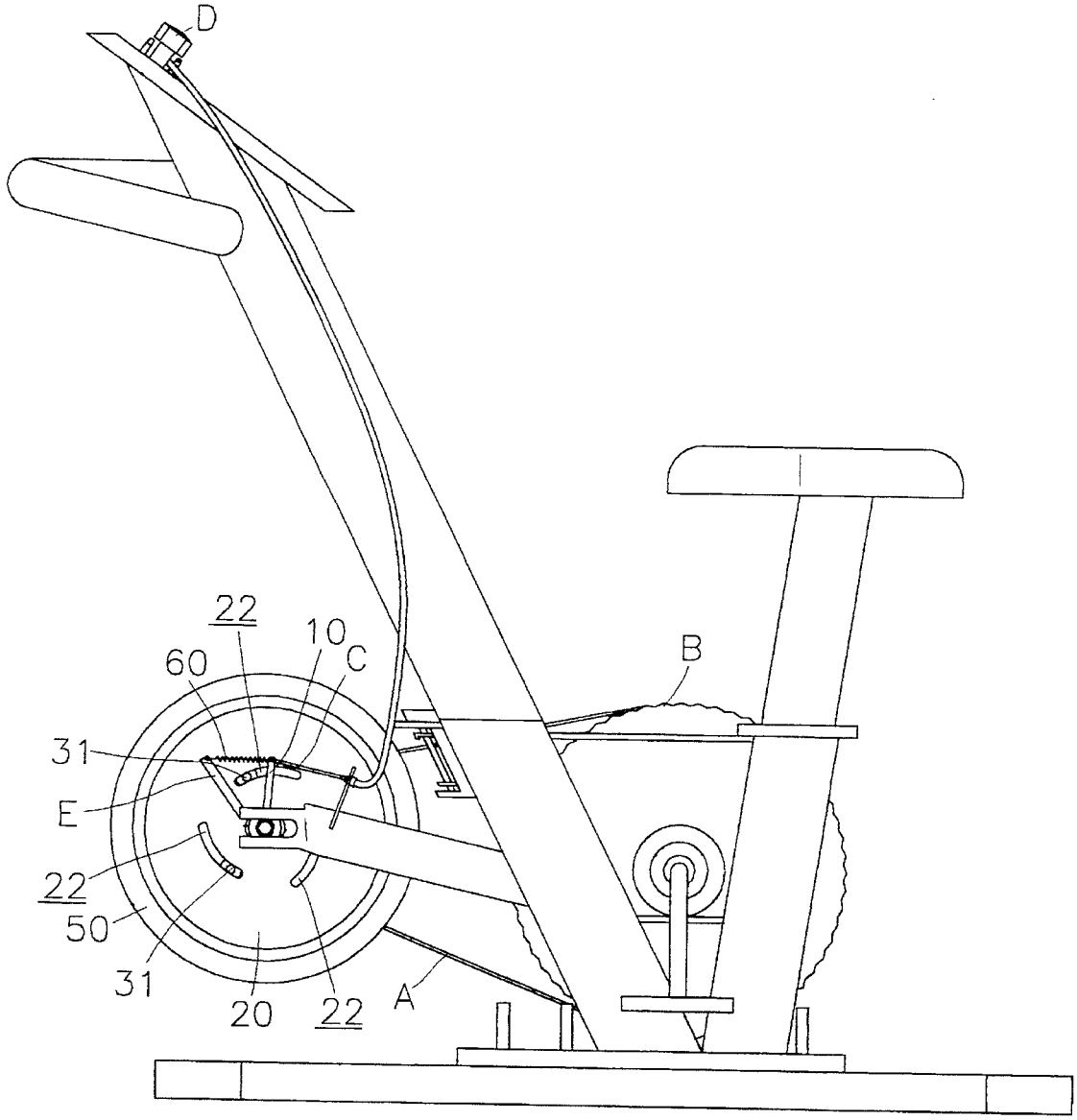
FIG. 3 is a preferred embodiment of the present invention.
Figure 4:
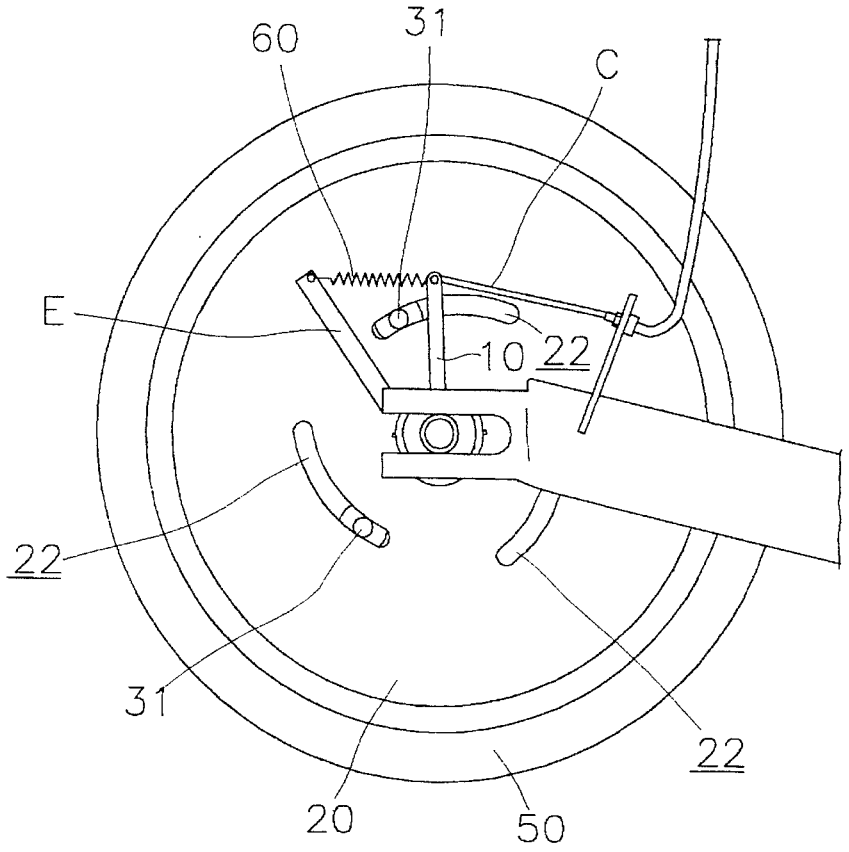
FIG. 4 is a partial enlarged view shown a detailed combinative view of a rotary handle and brake cable of the present invention.

Referring again to FIGS. 3 and 4, in practice the brake device of the present invention as shown in FIGS. 1 and 2 is directly assembled to the driving fly wheel structure of the exercise bicycle as shown in FIGS. 3 and 4, wherein the permeation fly wheel is engaged with driving element 50B through chain A and foot plate driving element B so the permeation fly wheel 50 is driven by the foot plate driving element B. The end of the rotary handle 10 is coupled to the brake operating cable C, and a button is used to control the displacement of the brake operating cable. Also, an elastic element 60 is connected between the end of the rotary handle 10 and the wheel axle frame E of the exercise bicycle, the elastic element 60 being formed by a spring or other component to restore the brake operating cable to an initial position.

Figure 5:
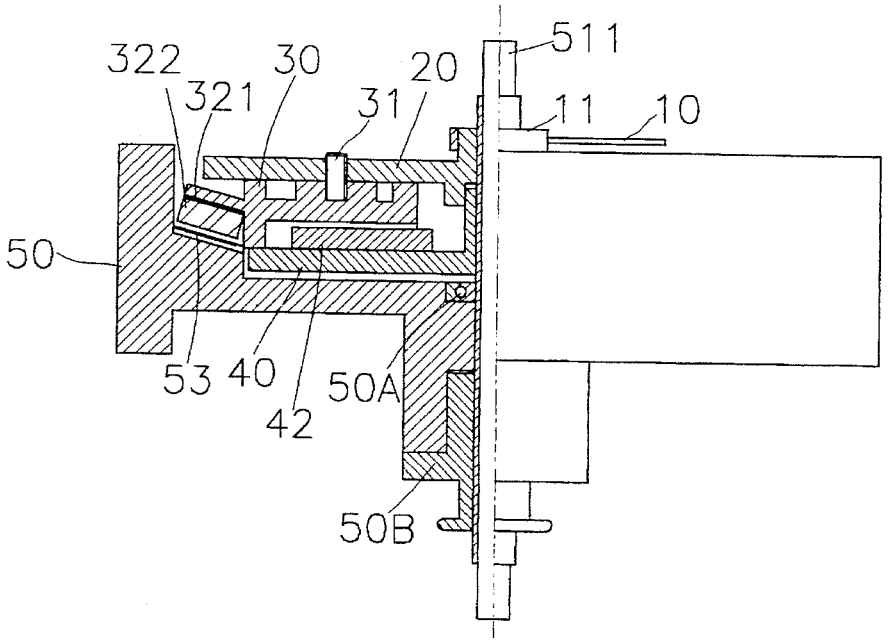
FIG. 5 is a sectional view shown the sector sliding block moving with the rotation of the rotary handle of the FIG. 4.

Referring to FIG. 5, in practice, in the brake device of the present invention as shown in FIGS. 1 and 2, when the permeation fly wheel 50 is rotated by the driving of the foot plate driving element B, the rotary button D is pulled or released, according to the exercise requirement and the brake construction, so that the rotary handle 10 is also rotated. The rotary disc 20, being fixed to the rotary handle 10, rotates therewith, thus causing a rotative displacement between the rotary disc 20 and the sector sliding blocks 30. As described previously, responsive to this rotative displacement, the positions of the sliding blocks 30 correspondingly expand or contract so that the magnetic gap between the permeation fly wheel 50 and the permanent magnets 322 can be changed, as shown in the FIG. 5, i.e., the magnetic gap and the magnetic contacting area are minimized. Therefore, the magnetic force induced by the interaction of the permeation fly wheel 50 and the permanent magnets 322 can be adjusted and thus the brake force (loading force) respective to the operation of the permeation fly wheel 50 can also be adjusted, but this adjustment can be performed by the stepless pulling or releasing operation between the elastic element 60 and the rotary handle 10.

From the aforementioned description, it is appreciated that the present invention has advantages and utility in the industry. The effects, advantages and utilities are summarized by the following:

(1) There is a reduction of elements so that the invention is easy to assemble and the cost is low:

The brake device of the present invention comprises mainly a rotary handle 10, rotary disk 20, sector sliding block 30, fixing rail disk 40, permeation fly wheel 50 and other components, so that there is a parts saving in the present invention, the invention is easy to assemble, and the cost and labor hours are also decreased.

(2) The invention is easy to operate and the brake force can be adjusted steplessly and accurately:

In the brake device of the present invention, the brake force can be adjusted accurately owing to the convenient operation of the brake operating cable C and the stepless adjustment of the magnetic gap and the magnetic contacting area between the aluminum sheets of the permeation fly wheel 50 and the permanent magnet 322 of the sector sliding block 30.

While the invention has been described in connection with what is presently considered to be the most practical and preferred embodiment, it is to be understood that the invention is not to be limited to the disclosed embodiment, but to the contrary, it is intended to cover various modifications and equivalent arrangements included within the spirit and scope of the Claims.

We claim:

1. A flywheel brake device for an exercise bicycle comprising:

a fixed axle;

a rotary disc having a hollow flange at a center thereof for rotatively coupling said rotary disc to said fixed axle, said rotary disc having a plurality of cambered slots formed therethrough, said cambered slots being angularly displaced one from the other about said center by a predetermined angle, each of said cambered slots including a far and a near end thereof, said far end being positioned at a first predetermined radial distance from said hollow flange and said near end being positioned at a second predetermined radial distance from said hollow flange, said first predetermined radial distance being greater than said second predetermined radial distance;

a rotary handle fixedly coupled to said hollow flange of said rotary disk for rotatively displacing said rotary disk relative to said fixed axle;

a fixing rail disc having a hollow sleeve spindle extending from a central portion, said hollow sleeve spindle being fixedly coupled to said fixed axle for securing said fixing rail disc in spaced relationship with said rotary disc, said fixing rail disc having substantially planar opposing first and second sides, said first side having a plurality of V-shaped rails formed thereon;

a plurality of substantially identical sector shaped sliding blocks disposed on said V-shaped rails of said fixing rail disc, said plurality of sliding blocks being arranged adjacent each other about said fixed axle, each of said sliding blocks having substantially planar first and second opposing surfaces, said first surface being positioned adjacent said rotary disc and having formed thereon a plurality of convex columns extending from said first surface for respective insertion into said plurality of cambered slots of said rotary disc, each of said cambered slots defining a cambered path along which a respectively inserted convex column travels responsive to a bi-directional rotative displacement of said rotary disc, each of said sliding blocks correspondingly sliding radially inward and radially outward as its convex column traverses a respective one of said cambered paths responsive to said rotative displacement of said rotary disc, each of said sliding blocks including an arcuate outer edge from which extends a cambered surface for supporting a plurality of permanent magnets thereon;

a flywheel formed of a magnetic material and rotatively coupled to said fixed axle, said flywheel having a driving element fixedly coupled to a central portion thereof for rotatably driving said flywheel about said fixed axle, said flywheel having a substantially annular cavity formed in one side thereof for positioning therein said rotary disc, said plurality of sliding blocks and said fixing rail disc, said annular cavity including a bevelled magnetic surface positioned adjacent said second side of said fixing rail disc, said bevelled magnetic surface having adhered thereto a layer of a non-magnetic metal, said bevelled magnetic surface and said plurality of permanent magnets of said plurality of sliding blocks having defined therebetween a magnetic gap of adjustable width; and, a flywheel brake operating cable coupled to said rotary handle for effecting said bi-directional rotative displacement of said rotary disc relative to said plurality of sliding blocks, said magnetic gap respectively narrowing and widening as said sliding blocks slide radially inward and outward in response to said bi-directional rotative displacement of said rotary disc to vary the magnetic coupling between said magnetic flywheel and said integral and permanent magnets of said plurality of sliding blocks.

2. The flywheel brake device for an exercise bicycle as recited in claim 1, further comprising an elastic restoring means for restoring said flywheel brake operating cable to an initial position, said elastic restoring means being coupled between said rotary handle and a wheel axle frame of said exercise bike.

3. The flywheel brake device for an exercise bicycle as recited in claim 1 where said rotary handle is fixedly coupled to said hollow flange of said rotary disc by at least one fixing pin member.

4. The flywheel brake device for an exercise bicycle as recited in claim 1 where said V-shaped rails dimensionally correspond to said second planar side of a respective one of said sliding blocks.

5. The flywheel brake device for an exercise bicycle as recited in claim 1 where said layer of non-magnetic material is copper.

6. The flywheel brake device for an exercise bicycle as recited in claim 1 where said layer of non-magnetic material is aluminum.

* * * * *